US010541071B2

(12) United States Patent
Tada et al.

(10) Patent No.: US 10,541,071 B2
(45) Date of Patent: Jan. 21, 2020

(54) ELECTRICAL STEEL SHEET

(71) Applicant: NIPPON STEEL & SUMITOMO METAL CORPORATION, Tokyo (JP)

(72) Inventors: Hirotoshi Tada, Tokyo (JP); Satoshi Kano, Tokyo (JP); Ichiro Tanaka, Tokyo (JP); Hiroyoshi Yashiki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 233 days.

(21) Appl. No.: 15/311,609

(22) PCT Filed: Jun. 26, 2015

(86) PCT No.: PCT/JP2015/068497
§ 371 (c)(1),
(2) Date: Nov. 16, 2016

(87) PCT Pub. No.: WO2015/199211
PCT Pub. Date: Dec. 30, 2015

(65) Prior Publication Data

US 2017/0098498 A1 Apr. 6, 2017

(30) Foreign Application Priority Data

Jun. 26, 2014 (JP) ..... 2014-131043

(51) Int. Cl.
*C22C 38/02* (2006.01)
*C22C 38/50* (2006.01)
(Continued)

(52) U.S. Cl.
CPC ..... *H01F 1/14716* (2013.01); *C21D 8/12* (2013.01); *C22C 38/001* (2013.01);
(Continued)

(58) Field of Classification Search
CPC ..... H01F 1/14716; H01F 1/14475; H01F 1/14791; H01F 1/16; C21D 8/12;
(Continued)

(56) References Cited

U.S. PATENT DOCUMENTS 5,250,123 A * 10/1993 Yashiki ..... C21D 8/12 148/111
5,425,820 A * 6/1995 Yashiki ..... C21D 8/12 148/307

(Continued)

FOREIGN PATENT DOCUMENTS

CN 103052722 A 4/2013
JP 11-236618 A 8/1999

(Continued)

OTHER PUBLICATIONS

Chinese Office Action and Search Report, dated Aug. 17, 2017, for Chinese Application No. 201580031816.3, with an English translation of the Chinese Office Action.

(Continued)

*Primary Examiner* — Patricia L. Hailey
(74) *Attorney, Agent, or Firm* — Birch, Stewart, Kolasch & Birch, LLP

(57) ABSTRACT

An electrical steel sheet includes: a specific chemical composition; a crystal grain diameter of 20 μm to 300 μm; and a texture satisfying Expression 1, Expression 2, and Expression 3 when the accumulation degree of the (001)[100] orientation is represented as $I_{Cube}$ and the accumulation degree of the (011)[100] orientation is represented as $I_{Goss}$.

$I_{Goss}+I_{Cube} \geq 10.5$ Expression 1

$I_{Goss}/I_{Cube} \geq 0.50$ Expression 2

$I_{Cube} \geq 2.5$ Expression 3

8 Claims, 2 Drawing Sheets

(51) Int. Cl.

| | |
|---|---|
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C21D 8/12*** | (2006.01) |
| ***H01F 1/16*** | (2006.01) |
| ***H01F 1/147*** | (2006.01) |
| ***C22C 38/00*** | (2006.01) |
| ***C22C 38/42*** | (2006.01) |

(52) U.S. Cl.
CPC ..... *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *H01F 1/14775* (2013.01); *H01F 1/14791* (2013.01)

(58) Field of Classification Search
CPC ..... C22C 38/00; C22C 38/001; C22C 38/002; C22C 38/008; C22C 38/02; C22C 38/04; C22C 38/06; C22C 38/42; C22C 38/50; C22C 38/60
See application file for complete search history.

(56) References Cited

U.S. PATENT DOCUMENTS

| | | | | |
|---|---|---|---|---|
| 6,322,639 | B1 | 11/2001 | Matsuzaki et al. | |
| 6,340,399 | B1 * | 1/2002 | Tanaka | C22C 38/002 148/308 |
| 2009/0202383 | A1 * | 8/2009 | Tanaka | C22C 38/004 420/83 |
| 2013/0125601 | A1 | 5/2013 | Kubota et al. | |
| 2013/0263981 | A1 | 10/2013 | Zaizen et al. | |
| 2015/0000793 | A1 | 1/2015 | Park et al. | |
| 2015/0197835 | A1 * | 7/2015 | Inaguma | C21D 8/0257 428/659 |
| 2017/0233842 | A1 * | 8/2017 | Yashiki | C22C 38/02 428/457 |

FOREIGN PATENT DOCUMENTS

| | | | | |
|---|---|---|---|---|
| JP | 2000-104144 | A | 4/2000 | |
| JP | 2000-160250 | A | 6/2000 | |
| JP | 2000-160256 | A | 6/2000 | |
| JP | 2008-127600 | * | 6/2008 | C21D 8/12 |
| JP | 2008-127600 | A | 6/2008 | |
| JP | 2008-189976 | A | 8/2008 | |
| JP | 2012-36454 | A | 2/2012 | |
| JP | 2012-36457 | A | 2/2012 | |
| JP | 2014-77199 | A | 5/2014 | |
| WO | WO 2013/100698 | A1 | 7/2013 | |

OTHER PUBLICATIONS

English translation of International Preliminary Report on Patentability dated Jan. 5, 2017, issued in PCT/JP2015/068497 (Forms PCT/IB/338; PCT/IB/373 and PCT/ISA/237).
Extended European Search Report for counterpart European Application No. 15812138.4, dated Oct. 30, 2017.
International Search Report, issued in PCT/JP2015/068497, dated Oct. 6, 2015.
Tada et al., "A Hysteresis Loss Modeling of Grain Oriented Electrical Steel Sheet", Journal of the Iron & Steel Institute of Japan, Mar. 1, 2013, vol. 99, No. 3, pp. 254-259.
Tada et al., "Influence of magnetostriction on hysteresis loss of electrical steel sheet", Journal of Magnetism and Magnetic Materials, Sep. 16, 2012, vol. 326, pp. 217-219. Form.
Taiwanese Office Action for Application No. 104120927, dated Mar. 10, 2016.
Written Opinion of the International Searching Authority (PCT/ISA/237), issued in PCT/JP2015/068497, dated Oct. 6, 2015.

* cited by examiner

ELECTRICAL STEEL SHEET

TECHNICAL FIELD

The present invention relates to an electrical steel sheet.

BACKGROUND ART

In recent years, products with less consumption energy have been developed in the fields of vehicles, home electric appliances, and so on due to a need to reduce global greenhouse gas. In the field of vehicles, for example, there are a hybrid drive vehicle with a combination of a gasoline engine and a motor and a fuel-efficient vehicle such as a motor drive electric vehicle. Further, in the field of home electric appliances, there are a high-efficiency air conditioner, a refrigerator, and so on, each of which has less annual electrical usage. The technique common to these is a motor, and increasing efficiency of a motor is an important technique.

Then, in recent years, a divided iron core advantageous in terms of winding design and yield has been often employed for a stator of a motor. Normally, the divided iron core is often fixed to a case by shrink fitting, and when a compressive stress acts on an electrical steel sheet by shrink fitting, magnetic properties of the electrical steel sheet decrease. Conventionally, studies for suppressing such a decrease in magnetic properties have been conducted.

However, a conventional electrical steel sheet is likely to be affected by a compressive stress, and therefore not able to exhibit excellent magnetic properties when used for a divided iron core, for example.

CITATION LIST

Patent Literature

Patent Literature 1: Japanese Laid-open Patent Publication No, 2008-189976

Patent Literature 2: Japanese Laid-open Patent Publication No. 2000-104144

Patent Literature 3: Japanese Laid-open Patent Publication No. 2000-160256

Patent Literature 4: Japanese Laid open Patent Publication No. 2000-160250

Patent Literature 5: Japanese Laid-open Patent Publication No. 11-236618

Patent Literature 6: Japanese Laid-open Patent Publication No. 2014-77199

Patent Literature 7: Japanese Laid-open Patent Publication No. 2012-36457

Patent Literature 8: Japanese Laid-open Patent Publication No. 2012-36454

SUMMARY OF INVENTION

Technical Problem

An object of the present invention is to provide an electrical steel sheet capable of exhibiting excellent magnetic properties even when a compressive stress acts thereon.

Solution to Problem

The present inventors conducted earnest studies in order to clarify the reason why excellent magnetic properties cannot be obtained when a conventional electrical steel sheet is used for a divided iron core. As a result, it was revealed that the relationship between the direction in which a compressive stress acts and crystal orientations of an electrical steel sheet is important.

The compressive stress to act on the electrical steel sheet will be explained. A drive motor of a hybrid vehicle and a compressor motor of an air conditioner are multipolar, and therefore, normally the direction of a magnetic flux passing through a teeth part of a stator corresponds to the rolling direction (to be sometimes referred to as "L direction" hereinafter) of the electrical steel sheet, and the direction of a magnetic flux passing through a yoke part corresponds to the direction perpendicular to the rolling direction and the sheet thickness direction (to be sometimes referred to as "C direction" hereinafter). When the divided iron core is fixed to a case or the like by shrink fitting, a compressive stress in the C direction acts on the electrical steel sheet of the yoke part, but no stress acts on the electrical steel sheet of the teeth part. Accordingly, the electrical steel sheet used for the divided iron core is desired to be able to exhibit excellent magnetic properties in the C direction under the compressive stress acting in the C direction while exhibiting excellent magnetic properties in the L direction under no stress.

The present inventors further conducted earnest studies in order to clarify the constitution for exhibiting such magnetic properties. As a result, it was revealed that crystal grains in the Goss orientation are not likely to be affected by the compressive stress in the C direction and the decrease in magnetic properties in the C direction is not easily caused even if the compressive stress in the C direction is applied, and crystal grains in the Cube orientation are likely to be affected by the compressive stress in the C direction and the decrease in magnetic properties in the C direction is easily caused when the compressive stress in the C direction is applied. Then, it was revealed that excellent magnetic properties can be obtained by appropriately controlling the accumulation degree of the (001)[100] orientation and the accumulation degree of the (011)[100] orientation.

As a result that the present inventors further conducted earnest studies repeatedly based on such findings, they have reached the following various aspects of the invention.

(1) An electrical steel sheet includes:

a chemical composition represented by, in mass %:

C: 0.010% or less;

Si: 1.30% to 3.50%;

Al: 0.0000% to 1.6000%;

Mn: 0.01% to 3.00%;

S: 0.0100% or less;

N: 0.010% or less;

P: 0.000% to 0.150%;

Sn: 0.000% to 0.150%;

Sb: 0.000% to 0.150%;

Cr: 0.000% to 1.000%;

Cu: 0.000% to 1.000%;

Ni: 0.000% to 1.000%;

Ti: 0.010% or less;

V: 0.010% or less;

Nb: 0.010% or less; and balance: Fe and impurities;

a crystal grain diameter of 20 μm to 300 μm; and a texture satisfying Expression 1, Expression 2, and Expression 3 when the accumulation degree of the (001)

[100] orientation is represented as $I_{Cube}$ and the accumulation degree of the (011)[100] orientation is represented as $I_{Goss}$.

$$I_{Goss}+I_{Cube}\geq 10.5 \quad \text{Expression 1}$$

$$I_{Goss}/I_{Cube}\geq 0.50 \quad \text{Expression 2}$$

$$I_{Cube}\geq 2.5 \quad \text{Expression 3}$$

(2) The electrical steel sheet according to (1), wherein the texture satisfies Expression 4, Expression 5, and Expression 6.

$$I_{Goss}+I_{Cube}\geq 10.7 \quad \text{Expression 4}$$

$$I_{Goss}/I_{Cube}\geq 0.52 \quad \text{Expression 5}$$

$$I_{Cube}\geq 2.7 \quad \text{Expression 6}$$

(3) The electrical steel sheet according to (1) or (2), further includes:

magnetic properties satisfying Expression 7 and Expression 8 when a saturation magnetic flux density is represented as Bs, a magnetic flux density in the rolling direction at being magnetized by a magnetizing force of 5000 A/m is represented as B50L, and a magnetic flux density in the direction perpendicular to the rolling direction and the sheet thickness direction (sheet width direction) at being magnetized by a magnetizing force of 5000 A/m is represented as B50C.

$$B50C/Bs\geq 0.790 \quad \text{Expression}$$

$$(B50L-B50C)/Bs\geq 0.070 \quad \text{Expression 8}$$

(4) The electrical steel sheet according to (3), wherein the magnetic properties satisfy Expression 9.

$$(B50L-B50C)/Bs\geq 0.075 \quad \text{Expression 9}$$

(5) The electrical steel sheet according to (3) or (4), wherein the magnetic properties satisfy Expression 10.

$$B50C/Bs\geq 0.825 \quad \text{Expression 10}$$

(6) The electrical steel sheet according to any one of (1) to (5), wherein in the chemical composition, P: 0.001% to 0.150%, Sri: 0.001% to 0.150%, or Sb: 0.001% to 0.150%, or any combination thereof is satisfied.

(7) The electrical steel sheet according to any one of (1) to (6), wherein in the chemical composition, Cr: 0.005% to 1.000%, Cu: 0.005% to 1.000%, or Ni: 0.005% to 1.000%, or any combination thereof is satisfied.

(8) The electrical steel sheet according to any one of (1) to (7), wherein a thickness thereof is 0.10 mm to 0.50 mm.

Advantageous Effects of Invention

According to the present invention, an appropriate texture is included, thereby making it possible to exhibit excellent magnetic properties even when a compressive stress acts.

DESCRIPTION OF EMBODIMENTS

Figure 1:
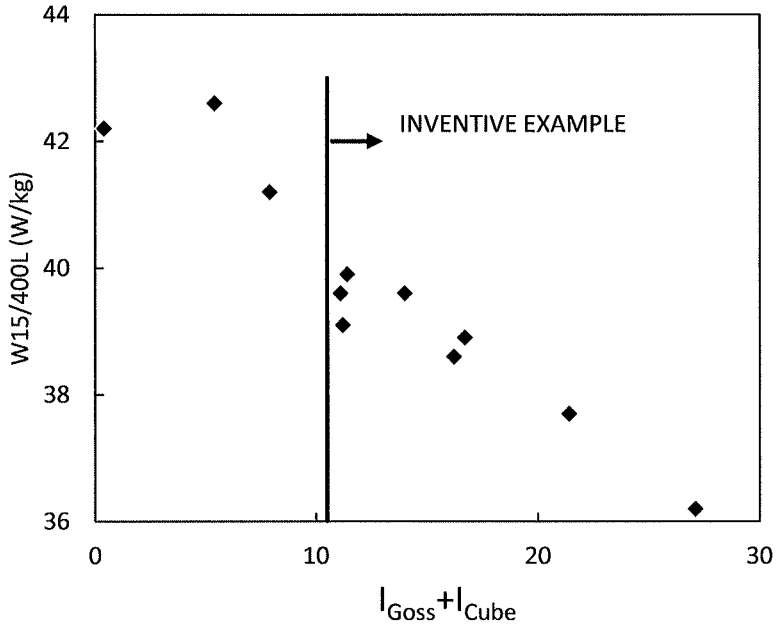
FIG. 1 is a view illustrating a relationship between an accumulation degree and a core loss W15/4001, obtained in a first test.

Hereinafter, embodiments of the present invention will be described in detail with reference to the attached drawings.

First, a texture of an electrical steel sheet according to the embodiment of the present invention will be described. The electrical steel sheet according to the embodiment of the present invention has a texture satisfying Expression 1, Expression 2, and Expression 3 when the accumulation degree of the (001)[100] orientation (to be sometimes referred to as "Cube orientation" hereinafter) is represented as $I_{Cube}$ and the accumulation degree of the (011)[100] orientation (to be sometimes referred to as "Goss orientation" hereinafter) is represented as $I_{Goss}$. The accumulation degree of a certain orientation means the ratio of an intensity in the orientation to a random intensity (random ratio), and is an index used normally when a texture is indicated.

$$I_{Goss}+I_{Cube}\geq 10.5 \quad \text{Expression 1}$$

$$I_{Goss}/I_{Cube}\geq 0.50 \quad \text{Expression 2}$$

$$I_{Cube}\geq 2.5 \quad \text{Expression 3}$$

Crystal grains in the Goss orientation contribute to an improvement in magnetic properties particularly in the L direction. Crystal grains in the Cube orientation contribute to improvements in magnetic properties in the L direction and magnetic properties in the C direction. As described above, the present inventors revealed that the crystal grains in the Goss orientation are not likely to be affected by the compressive stress in the C direction and the decrease in magnetic properties in the C direction is not easily caused even when the compressive stress in the C direction is applied, and the crystal grains in the Cube orientation are likely to be affected by the compressive stress in the C direction and the decrease in magnetic properties in the C direction is caused easily when the compressive stress in the C direction is applied.

When the value of "$I_{Goss}+I_{Cube}$" is less than 10.5, sufficient magnetic properties in the L direction cannot be obtained under no stress. Thus, Expression 1 needs to be satisfied. For the purpose of obtaining more excellent magnetic properties in the L direction under no stress, the value of "$I_{Goss}$ $I_{Cube}$" is preferably 10.7 or more and more preferably 11.0 or more.

When the value of "$I_{Goss}/I_{Cube}$" is less than 0.50, sufficient magnetic properties in the C direction cannot be obtained when the compressive stress in the C direction is applied. Thus, Expression 2 needs to be satisfied. For the purpose of obtaining more excellent magnetic properties in the C direction under the compressive stress in the C direction, the value of "$I_{Goss}/I_{Cube}$" is preferably 0.52 or more and more preferably 0.55 or more. The relationship between the value of "$I_{Goss}/I_{Cube}$" and the magnetic properties in the C direction under the compressive stress in the C direction is not clear, but is thought as follows. In general, when the compressive stress acts in the <100> direction, the magnetic properties are likely to deteriorate rather than the case when the compressive stress acts parallel to the <110> direction.

The C direction of crystal grains in the (001)[100] orientation (Cube orientation) corresponds to the [010] direction, and the C direction of crystal grains in the (011)[100] orientation (Goss orientation) corresponds to the [01-1] direction. Thus, it is thought that as the value of "$I_{Goss}/I_{Cube}$" is lower, namely as the ratio of crystal grains in the Cube orientation is higher, the ratio of the crystal grains in the <100> direction parallel to the C direction is higher and the magnetic properties of the electrical steel sheet are more likely to decrease by the compressive stress in the C direction.

Also when the value of "$I_{Cube}$" is less than 2.5, sufficient magnetic properties in the C direction cannot be obtained when the compressive stress in the C direction is applied. Thus, Expression 3 needs to be satisfied. For the purpose of obtaining more excellent magnetic properties in the C direction under the compressive stress in the C direction, the value of "$I_{Cube}$" is preferably 2.7 or more and more preferably 3.0 or more.

When Expression 3 is not satisfied even though Expression 2 is satisfied, although the magnetic properties in the C direction are not likely to decrease by the compressive stress in the C direction, sufficient magnetic properties in the C direction cannot be obtained under no stress, and therefore the magnetic properties in the C direction under the compressive stress in the C direction are not sufficient. When Expression 2 and Expression 3 are not satisfied, sufficient magnetic properties in the C direction cannot be obtained under no stress and the magnetic properties in the C direction decrease by the compressive stress in the C direction, and therefore the magnetic properties in the C direction under the compressive stress in the C direction are not sufficient. When Expression 2 is not satisfied even though Expression 3 is satisfied, although sufficient magnetic properties in the C direction can be obtained under no stress, the magnetic properties in the C direction decrease by the compressive stress in the C direction, and therefore the magnetic properties in the C direction under the compressive stress in the C direction are not sufficient. When Expression 2 and Expression 3 are satisfied, sufficient magnetic properties in the C direction can be obtained under no stress and the magnetic properties in the C direction are not likely to decrease by the compressive stress in the C direction, and therefore excellent magnetic properties in the C direction can be obtained under the compressive stress in the C direction.

The accumulation degree $I_{Goss}$ and the accumulation degree $I_{Cube}$ can be measured in the following manner. First, (110), (200), and (211) pole figures of an electrical steel sheet being a measuring object are measured by the X-ray diffraction Schultz method. At this time, measuring positions are the position where the depth of the electrical steel sheet from the surface is ¼ of the thickness (to be sometimes referred to as "¼ position" hereinafter) and the position where the depth of the electrical steel sheet from the surface is ½ of the thickness (to be sometimes referred to as "½ position" hereinafter). Next, a three-dimensional orientation analysis is performed by the series expansion method using the pole figures. The average value of three-dimensional orientation distribution densities at the ¼ position and the ½ position is calculated with respect to each of the (001)[100] orientation (Cube orientation) and the (011)[100] orientation (Goss orientation) obtained by the analysis. The two types of values obtained in this manner can be the accumulation degree $I_{Goss}$ and the accumulation degree $I_{Cube}$ respectively.

As described above, the texture preferably satisfies Expression 4, Expression 5, and Expression 6.

$$I_{Goss}+I_{Cube}\geq 10.7 \quad \text{Expression 4}$$

$$I_{Goss}/I_{cube}\geq 0.52 \quad \text{Expression 5}$$

$$I_{Cube}\geq 2.7 \quad \text{Expression 6}$$

Next, magnetic properties of the electrical steel sheet according to the embodiment of the present invention will be described. The electrical steel sheet according to the embodiment of the present invention preferably has magnetic properties satisfying Expression 7 and Expression 8 when a saturation magnetic flux density is represented as Bs, a magnetic flux density in the rolling direction at being magnetized by a magnetizing force of 5000 A/m is represented as B50L, and a magnetic flux density in the direction perpendicular to the rolling direction and the sheet thickness direction (sheet width direction) at being magnetized by a magnetizing force of 5000 A/m is represented as B50C.

$$B50C/Bs\geq 0.790 \quad \text{Expression 7}$$

$$(B50L-B50C)/Bs\geq 0.070 \quad \text{Expression 8}$$

When the value of "B50C/Bs" is less than 0.790, sufficient magnetic properties in the C direction sometimes may not be obtained under the compressive stress. Thus, Expression 7 is preferably satisfied. For the purpose of obtaining more excellent magnetic properties in the C direction under the compressive stress in the C direction, the value of "B50C/Bs" is more preferably 0.795 or more and further preferably 0.800 or more. On the other hand, when "B50C/Bs" is too high, the magnetic properties may become likely to deteriorate by the compressive stress, so that the value of "B50C/Bs" is preferably 0.825 or less, further preferably 0.820 or less, and furthermore preferably 0.815 or less.

When the value of "(B501−B50C)/Bs" is less than 0.070, sufficient magnetic properties in the C direction sometimes may not be obtained under the compressive stress. Thus, Expression 8 is preferably satisfied. The magnetic properties may become likely to deteriorate by the compressive stress, so that the value of "(B50L−B50C)/Bs" is more preferably 0.075 or more and further preferably 0.080 or more.

As described above, the magnetic properties preferably satisfy Expression 9 or Expression 10 or the both.

$$(B50L-B50C)/Bs\geq 0.075 \quad \text{Expression 9}$$

$$B50C/Bs\leq 0.825 \quad \text{Expression 10}$$

Next, a chemical composition of the electrical steel sheet according to the embodiment of the present invention and a slab used for manufacture of the electrical steel sheet will be described. The electrical steel sheet according to the embodiment of the present invention is manufactured by hot rolling of slab, hot-rolled sheet annealing, first cold rolling, intermediate annealing, second cold rolling, finish annealing, and the like, of which details will be described later. Thus, not only properties of the electrical steel sheet but also these processes are considered in the chemical composition of the electrical steel sheet and the slab. In the following description, "%" being a unit of a content of each element contained in the electrical steel sheet means "mass %" unless otherwise specified. The electrical steel sheet according to the embodiment includes a chemical composition represented by C: 0.010% or less, Si: 1.30% to 3.50%, Al: 0.0000% to 1.6000%, Mn: 0.01% to 3.00%, S: 0.0100% or less, N: 0.010% or less, P: 0.000% to 0.150%, Sn: 0.000% to 0.150%, Sb: 0.000% to 0.150%, Cr: 0.000% to 1.000%, Cu: 0.000% to 1.000%, Ni: 0.000% to 1.000%, Ti: 0.010% or less, V: 0.010% or less, Nb: 0.010% or less, and balance:

Fe and impurities. Examples of the impurities include ones contained in raw materials such as ore and scrap, and ones mixed in a manufacturing process.

(Si: 1.30% to 3.50%)

Si is an element effective for increasing specific resistance to reduce a core loss. When the content of Si is 1.30% or more, it is possible to more securely obtain the specific resistance improving effect. Thus, the content of Si is 1.30% or more. The content of Si is preferably 1.60% or more and more preferably 1.90% or more. On the other hand, when the content of Si is greater than 3.50%, a desired texture cannot be obtained and a desired magnetic flux density cannot be obtained. Thus, the content of Si is 3.50% or less. The content of Si is preferably 3.30% or less and more preferably 3.10% or less. The reason why a desired texture cannot be obtained when the content of Si is greater than 3.50% is thought that a change in deformation behavior in cold rolling is caused due to an increase in the content of Si.

(Al: 0.0000% to 1.6000%)

Al is an element to decrease a saturation magnetic flux density. When the content of Al is greater than 1.6000%, a desired texture cannot be obtained and a desired magnetic flux density cannot be obtained. Thus, the content of Al is 1.6000% or less. The content of Al is preferably 1.4000% or less, more preferably 1.2000% or less, and further preferably 0.8000% or less. The reason why a desired texture cannot be obtained when the content of Al is greater than 1.6000% is thought that a change in deformation behavior in cold rolling is caused due to an increase in the content of Al. The lower limit of the content of Al is not limited in particular. Al has an effect of increasing specific resistance to reduce a core loss, and for the purpose of obtaining this effect, the content of Al is preferably 0.0001% or more and more preferably 0.0003% or more.

(Mn: 0.01% to 3.00%)

Mn is an element effective for increasing specific resistance to reduce a core loss. When the content of Mn is 0.01% or more, it is possible to more securely obtain such a specific resistance improving effect. Thus, the content of Mn is 0.01% or more. The content of Mn is preferably 0.03% or more and more preferably 0.05% or more. On the other hand, when Mn is contained excessively, the magnetic flux density decreases. Such a phenomenon is significant when the content of Mn is greater than 3.00%. Thus, the content of Mn is 3.00% or less. The content of Mn is preferably 2.70% or less, more preferably 2.50% or less, and further preferably 2.40% or less.

(C: 0.010% or less)

C is not an essential element but is contained in a steel as an impurity, for example. C is an element to deteriorate magnetic properties by magnetic aging. Thus, the lower the content of C is, the better it is. Such deterioration of magnetic properties is significant when the content of C is greater than 0.010%. For this reason, the content of C is 0.010% or less. The content of C is preferably 0.008% or less and more preferably 0.005% or less.

(S: 0.0100% or less)

S is not an essential element but is contained in a steel as an impurity, for example. S bonds to Mn in a steel to form fine MnS to inhibit grain growth during finish annealing and deteriorate magnetic properties. Thus, the lower the content of S is, the better it is. Such deterioration of magnetic properties is significant when the content of S is greater than 0.0100%. For this reason, the content of S is 0.0100% or less. The content of S is preferably 0.0080% or less and more preferably 0.0050% or less. S contributes to an improvement in magnetic flux density. For the purpose of obtaining this effect, 0.0005% or more of S may also be contained. The reason why S contributes to an improvement in magnetic flux density is thought that the grain growth in an orientation disadvantageous to the magnetic properties is inhibited by S.

(N: 0.010% or less)

N is not an essential element but is contained in a steel as an impurity, for example. N bonds to Al in a steel to form fine AlN to inhibit grain growth during finish annealing and deteriorate magnetic properties. Thus, the lower the content of N is, the better it is. Such deterioration of magnetic properties is significant when the content of N is greater than 0.010%. For this reason, the content of N is 0.010% or less. The content of N is preferably 0.008% or less and more preferably 0.005% or less.

P, Sn, Sb, Cr, Cu, and Ni are not essential elements but are arbitrary elements, which may be contained appropriately in the electrical steel sheet up to a specific amount as a limit.

(P: 0.000% to 0.150%, Sn: 0.000% to 0.150%, Sb: 0.000% to 0.150%)

P, Sn, and Sb each have an effect to improve the texture of the electrical steel sheet to improve magnetic properties. Thus, P, Sn, or Sb, or any combination thereof may also be contained. For the purpose of sufficiently obtaining this effect, P: 0.001% or more, Sn: 0.001% or more, or Sb: 0.001% or more or any combination thereof is preferable, and P: 0.003% or more, Sn: 0.003% or more, or Sb: 0.003% or more, or any combination thereof is more preferable. However, excessive P, Sn, and Sb may cause segregation in a crystal grain diameter to decrease ductility of the steel sheet, resulting in difficulty in cold rolling. Such a decrease in ductility is significant in the case of P: greater than 0.150%, Sn: greater than 0.150%, or Sb: greater than 0.150%, or any combination thereof. For this reason, P: 0.150% or less, Sn: 0.150% or less, and Sb: 0.150% or less are set. P: 0.100% or less, Sn: 0.100% or less, or Sb: 0.100% or less, or any combination thereof is preferable, and P: 0.050% or less, Sn: 0.050% or less, or Sb: 0.050% or less, or any combination thereof is more preferable. That is, P: 0.001% to 0.150%, Sn: 0.001% to 0.150%, or Sb: 0.001% to 0.150%, or any combination thereof is preferably satisfied.

(Cr: 0.000% to 1.000%, Cu: 0.000% to 1.000%, Ni: 0.000% to 1.000%)

Cr, Cu, and Ni are elements effective for increasing specific resistance to reduce a core loss. Thus, Cr, Cu, or Ni, or any combination thereof may also be contained. For the purpose of sufficiently obtaining this effect, Cr: 0.005% or more, Cu: 0.005% or more, or Ni: 0.005% or more, or any combination thereof is preferable, and Cr: 0.010% or more, Cu: 0.010% or more, or Ni: 0.010% or more, or any combination thereof is more preferable. However, excessive Cr, Cu, and Ni may deteriorate the magnetic flux density. Such deterioration of magnetic flux density is significant in the case of Cr: greater than 1.000%, Cu: greater than 1.000%, or Ni: greater than 1.000%, or any combination thereof. For this reason, Cr: 1.000% or less, Cu: 1.000% or less, and Ni: 1.000% or less are set. Cr: 0.500% or less, Cu: 0.500% or less, or Ni: 0.500% or less, or any combination thereof is preferable, and Cr: 0.300% or less, Cu: 0.300% or less, or Ni: 0.300% or less, or any combination thereof is more preferable. That is, Cr: 0.005% to 1.000%, Cu: 0.005% to 1.000%, or Ni: 0.005% to 1.000%, or any combination thereof is preferably satisfied.

(Ti: 0.010% or less, V: 0.010% or less, Nb: 0.010% or less)

Ti, V, and Nb are not essential elements but are contained in a steel as an impurity, for example. Ti, V, and Nb bond to C, N, Mn, or other element to form inclusions to inhibit growth of crystal grains during annealing and deteriorate magnetic properties. Thus, the lower the content of Ti, the content of V, and the content of Nb are, the better it is. Such deterioration of magnetic properties is significant in the case of Ti: greater than 0.010%, V: greater than 0.010%, or Nb: greater than 0.010%, or any combination thereof. For this reason, Ti: 0.010% or less, V: 0.010% or less, and Nb: 0.010% or less are set. Ti: 0.007% or less, V: 0.007% or less, or Nb: 0.007% or less, or any combination thereof is preferable, and Ti: 0.004% or less, V: 0.004% or less, or Nb: 0.004% or less, or any combination thereof is more preferable.

Next, an average crystal grain diameter of the electrical steel sheet according to the embodiment of the present invention will be described. Even when the average crystal grain diameter is too large or too small, the core loss deteriorates. Such deterioration of core loss is significant when the average crystal grain diameter is less than 20 μm or greater than 300 μm. Thus, the average crystal grain diameter is 20 μm to 300 μm. The lower limit of the average crystal grain diameter is preferably 30 μm and further preferably 40 μm. The upper limit of the average crystal grain diameter is preferably 250 μm and further preferably 200 μm.

As the average crystal grain diameter, the average value of crystal grain diameters measured in the sheet thickness direction and the rolling direction by the intercept method in a vertical section structure photograph parallel to the sheet thickness direction and the rolling direction can be used. As the vertical section structure photograph, an optical micrograph can be used, and, for example, a photograph taken at 50-fold magnification can be used.

Next, the thickness of the electrical steel sheet according to the embodiment of the present invention will be described. When the electrical steel sheet is too thin, productivity may deteriorate, resulting in that it is not easy to manufacture an electrical steel sheet having a thickness of less than 0.10 mm with high productivity. Thus, the sheet thickness is preferably 0.10 mm or more. The sheet thickness of the electrical steel sheet is more preferably 0.15 mm or more and further preferably 0.20 mm or more. On the other hand, when the electrical steel sheet is too thick, the core loss may deteriorate. Such deterioration of core loss is significant when the sheet thickness is greater than 0.50 mm. For this reason, the sheet thickness is preferably 0.50 mm or less. The sheet thickness of the electrical steel sheet is more preferably 0.35 mm or less and further preferably 0.30 mm or less.

Next, a preferred method of manufacturing the electrical steel sheet according to the embodiment will be described. In the manufacturing method, hot rolling of slab, hot-rolled sheet annealing, first cold rolling, intermediate annealing, second cold rolling, and finish annealing are performed.

In the hot rolling, for example, a slab having the above-described chemical composition is charged into a heating furnace and is subjected to hot rolling. When a slab temperature is high, it is also possible to start hot rolling without charging into a heating furnace. Various conditions of the hot rolling are not limited in particular. The slab can be obtained by continuous casting of a steel, or obtained by bloom rolling of a steel ingot, for example.

After the hot rolling, annealing of a hot-rolled steel sheet obtained by the hot rolling (hot-rolled sheet annealing) is performed. The hot-rolled sheet annealing may also be performed using a box furnace, and continuous annealing may also be performed as the hot-rolled sheet annealing. Hereinafter, annealing using a box furnace is sometimes referred to as box annealing. When the temperature of hot-rolled sheet annealing is too low and when the time for hot-rolled sheet annealing is too short, it may not be possible to sufficiently coarsen crystal grains, resulting in that desired magnetic properties sometimes may not be obtained. On the other hand, when the temperature of hot-rolled sheet annealing is too high and when the time for hot-rolled sheet annealing is too long, manufacturing costs may increase. When the box annealing is performed, for example, the hot-rolled steel sheet is preferably held for 1 hour to 200 hours at a temperature zone of 700° C. to 1100° C. The holding temperature when performing the box annealing is more preferably 730° C. or more and further preferably 750° C. or more. The holding temperature when performing the box annealing is more preferably 1050° C. or less and further preferably 1000° C. or less. The holding time when performing the box annealing is more preferably 2 hours or more and further preferably 3 hours or more. The holding time when performing the box annealing is more preferably 150 hours or less and further preferably 100 hours or less. In the case of performing the continuous annealing, for example, the hot-rolled steel sheet is preferably passed through a temperature zone of 750° C. to 1250° C. for a time period of 1 second to 600 seconds. The holding temperature when performing the continuous annealing is more preferably 780° C. or more and further preferably 800° C. or more. The holding temperature when performing the continuous annealing is more preferably 1220° C. or less and further preferably 1200° C. or less. The holding time when performing the continuous annealing is more preferably 3 seconds or more and further preferably 5 seconds or more. The holding time when performing the continuous annealing is more preferably 500 seconds or less and further preferably 400 seconds or less. The average crystal grain diameter of an annealed steel sheet obtained by the hot-rolled sheet annealing is preferably 20 μm or more, more preferably 35 μm or more, and further preferably 40 μm or more.

After the hot-rolled sheet annealing, cold rolling (first cold rolling) of the annealed steel sheet is performed. A cold rolling ratio of the first cold rolling (to be sometimes referred to as "first cold rolling ratio" hereinafter) is preferably 40% to 85%. When the first cold rolling ratio is less than 40% or greater than 85%, a desired texture may not be obtained and desired magnetic flux density and core loss cannot be obtained. The first cold rolling ratio is more preferably 45% or more and further preferably 50% or more. The first cold rolling ratio is more preferably 80% or less and further preferably 75% or less.

After the first cold rolling, annealing (intermediate annealing) of a cold-rolled steel sheet obtained by the first cold rolling (to be sometimes referred to as "intermediate cold-rolled steel sheet" hereinafter) is performed. As the intermediate annealing, box annealing may be performed, and continuous annealing may also be performed as the intermediate annealing. When the temperature of intermediate annealing is too low and when the time for intermediate annealing is too short, it may not be possible to sufficiently coarsen crystal grains, resulting in that desired magnetic properties sometimes may not be obtained. On the other hand, when the temperature of intermediate annealing is too high and when the time for intermediate annealing is too long, manufacturing costs may increase. When performing the box annealing, for example, the intermediate cold-rolled steel sheet is preferably held for 1 hour to 200 hours at a temperature zone of 850° C. to 1100° C. The holding temperature when performing the box annealing is more preferably 880° C. or more and further preferably 900° C. or more. The holding temperature when performing the box annealing is more preferably 1050° C. or less and further preferably 1000° C. or less. The holding time when performing the box annealing is more preferably 2 hours or more and further preferably 3 hours or more. The holding time when performing the box annealing is more preferably 150 hours or less and further preferably 100 hours or less. In the case of performing the continuous annealing, for example, the intermediate cold-rolled steel sheet is preferably passed through a temperature zone of 1050° C. to 1250° C. for a time period of 1 second to 600 seconds. The holding temperature when performing the continuous annealing is more preferably 1080° C. or more and further preferably 1110° C. or more. The holding temperature when performing the continuous annealing is more preferably 1220° C. or less and further preferably 1200° C. or less. The holding time when performing the continuous annealing is more preferably 2 seconds or more and further preferably 3 seconds or more. The holding time when performing the continuous annealing is more preferably 500 seconds or less and further preferably 400 seconds or less. The average crystal grain diameter of an intermediate annealed steel sheet obtained by the intermediate annealing is preferably 140 μm or more, more preferably 170 μm or more, and further preferably 200 μm or more. As the intermediate annealing, the box annealing is more preferable than the continuous annealing.

After the intermediate annealing, cold rolling (second cold rolling) of the intermediate annealed steel sheet obtained by the intermediate annealing is performed. A cold rolling ratio of the second cold rolling (to be sometimes referred to as "second cold rolling ratio" hereinafter) is preferably 45% to 85%. When the second cold rolling ratio is less than 45% or greater than 85%, a desired texture may not be obtained and desired magnetic flux density and core loss cannot be obtained. The second cold rolling ratio is more preferably 50% or more and further preferably 55% or more. The second cold rolling ratio is more preferably 80% or less and further preferably 75% or less.

After the second cold rolling, annealing (finish annealing) of a cold-rolled steel sheet obtained by the second cold rolling is performed. When the temperature of finish annealing is too low and when the time for finish annealing is too short, the average crystal grain diameter of 20 μm or more may not be obtained, resulting in that desired magnetic properties sometimes may not be obtained. On the other hand, in order to perform the finish annealing at a temperature greater than 1250° C., a special facility is needed, which may be disadvantageous economically. When the time for finish annealing is greater than 600 seconds, productivity may be low and it may be disadvantageous economically. The temperature of finish annealing is preferably 700° C. to 1250° C., and the time for finish annealing is preferably 1 second to 600 seconds. The temperature of finish annealing is more preferably 750° C. or more. The temperature of finish annealing is more preferably 1200° C. or less. The time for finish annealing is more preferably 3 seconds or more. The time for finish annealing is more preferably 500 seconds or less.

After the finish annealing, an insulating coating film may also be formed on the surface of the electrical steel sheet. As the insulating coating film, one made of only organic components, one made of only inorganic components, or one made of organic-inorganic compounds may also be formed. From a viewpoint of reducing environmental loads, an insulating coating film not containing chromium may also be formed. Insulating coating that exhibits adhesive ability by heating and pressurizing may also be performed as coating. As a coating material that exhibits adhesive ability, for example, an acrylic resin, a phenol resin, an epoxy resin, a melamine resin, or the like can be used.

Such an electrical steel sheet according to the embodiment is suitable for an iron core of a high-efficiency motor, particularly for a stator iron core of a high-efficiency divided iron core type motor. As the high-efficiency motor, for example, compressor motors of an air conditioner, refrigerator, and so on, drive motors of an electric vehicle, a hybrid vehicle, and so on, and a motor of a power generator are exemplified.

In the foregoing, the preferred embodiment of the present invention has been described in detail, but, the present invention is not limited to such an example. It is apparent that a person having common knowledge in the technical field to which the present invention belongs is able to devise various variation or modification examples within the range of technical ideas described in the claims, and it should be understood that such examples belong to the technical scope of the present invention as a matter of course.

EXAMPLE

Next, the electrical steel sheet according to the embodiment of the present invention will be concretely described while giving examples. Examples to be given below are just merely one example of the electrical steel sheet according to the embodiment of the present invention, and the electrical steel sheet according to the present invention is not limited to the following examples.

(First Test)

In the first test, the relationship between the texture and the magnetic properties was examined. First, a plurality of slabs each containing, in mass %, C: 0.002%, Si: 2.10%, Al: 0.0050%, Mn: 0.20%, S: 0.002%, N: 0.002%, P: 0.012%, Sn: 0.002%, Sb: 0.001%, Cr: 0.01%, Cu: 0.02%, Ni: 0.01%, Ti: 0.002%, V: 0.002%, and Nb: 0.003%, and balance being composed Fe and impurities were produced. Some of the slabs were subjected to hot rolling, and thereby hot-rolled steel sheets each having a sheet thickness of 2.5 mm were obtained, and then box annealing for holding at 800° C. for 10 hours, or continuous annealing for holding at 1000° C. for 30 seconds was performed as hot-rolled sheet annealing, and annealed steel sheets were obtained. Next, on the annealed steel sheets, cold rolling was performed one time, or cold rolling was performed two times with intermediate annealing performed therebetween, and cold-rolled steel sheets each having a sheet thickness of 0.30 mm were obtained. As the intermediate annealing, box annealing for holding at 950° C. for 10 hours, or continuous annealing for holding at a temperature of 900° C. to 1100° C. for 30 seconds was performed. The other slabs were each rough rolled to a sheet thickness of 10 mm in hot rolling, and then grinding of front and back surfaces was performed, and thereby ground sheets each having a thickness of 3 mm were obtained. Next, the ground sheets were each heated at 1150° C. for 30 minutes, and then subjected to finish rolling in one pass at 850° C. under the condition of a strain rate being 35 $s^{-1}$, and hot-rolled steel sheets each having a sheet thickness of 1.0 mm were obtained. Thereafter, hot-rolled sheet annealing to perform holding at 1000° C. for 30 seconds was performed, and then cold-rolled steel sheets each having a sheet thickness of 0.30 mm were obtained by cold rolling.

After the cold rolling, on the cold-rolled steel sheets, finish annealing for holding at 1000° C. for 1 second was performed, and electrical steel sheets were obtained. Measurement by the above-described Schultz method was performed to reveal that the accumulation degree $I_{Cube}$ was 0.1 to 10.0 and the accumulation degree $I_{Goss}$ was 0.3 to 23.8 as represented in Table 1 below. Measurement by the above-described method using a vertical section structure photograph was performed to reveal that the average crystal grain diameter was 66 μm to 72 μm.

A core loss and a magnetic flux density of respective samples were measured. As the core loss, a core loss W15/400L and a core loss W15/400C were measured. The core loss W15/400L is a core loss obtained when magnetization is performed in the L direction at a frequency of 400 Hz until the magnetic flux density of 1.5 T. The core loss W15/400C is a core loss obtained when magnetization is performed in the C direction at a frequency of 400 Hz until the magnetic flux density of 1.51. As the magnetic flux density, a magnetic flux density B50L and a magnetic flux density B50C were measured. The magnetic flux density B50L is a magnetic flux density in the L direction at being magnetized by a magnetizing force of 5000 A/m. The magnetic flux density B50C is a magnetic flux density in the C direction at being magnetized by a magnetizing force of 5000 A/m. The core loss W15/400L and the magnetic flux density B50L were measured without application of a compressive stress, and the core loss W15/400C and the magnetic flux density B50C were measured in a state where a compressive stress of 40 MPa was applied in the C direction. The magnetic property was measured by a 55-mm-square single sheet tester (SST) in conformity with JIS C 2556. Results thereof are represented in Table 1, and FIG. 1 and FIG. 2. In Table 1, each underline indicates that a corresponding numerical value is outside the present invention range or preferred range. In Table 1, the saturation magnetic flux density Bs was obtained by the following expression. [Si], [Mn], and [Al] are the contents of Si, Mn, and Al respectively.

$$Bs=2.1561-0.0413\times[Si]-0.0198\times[Mn]0.0604\times[Al]$$

As illustrated in FIG. 1, the higher the value of "$I_{Goss}+I_{Cube}$" was, the lower the core loss W15/400L was. This is inferred because the Goss orientation and the Cube orientation both are the orientation contributing to the improvement in the magnetic properties in the L direction, as described above.

Figure 2:
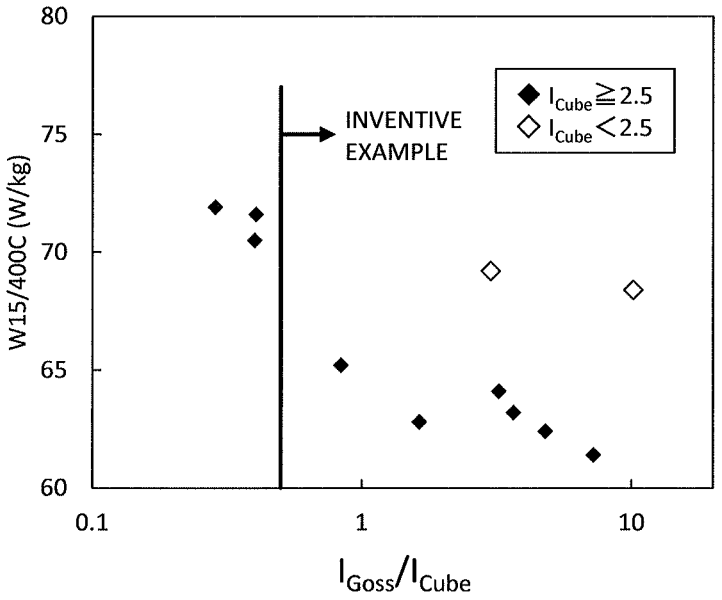
FIG. 2 is a view illustrating a relationship between the accumulation degree and a core loss W15/400C obtained in the first test.

As illustrated in FIG. 2, in the case of the value of "$I_{cube}$" being 2.5 or more, the higher the value of "$I_{Goss}/I_{Cube}$" was, the lower the core loss W15/400C was. This is inferred because as the value of "$I_{Goss}/I_{Cube}$" is higher, the ratio of crystal grains in the Cube orientation to be likely to be affected by the compressive stress in the C direction is higher, as described above.

As illustrated in FIG. 2, in the case of the value of "$I_{Cube}$" being less than 2.5, the core loss W15/400C was not as low as the case of the value of "$I_{Cube}$" being 2.5 or more. This is inferred because the crystal grains in the Cube orientation contributing to the improvement in the magnetic properties in the C direction were decreased, as described above.

Figure 3:
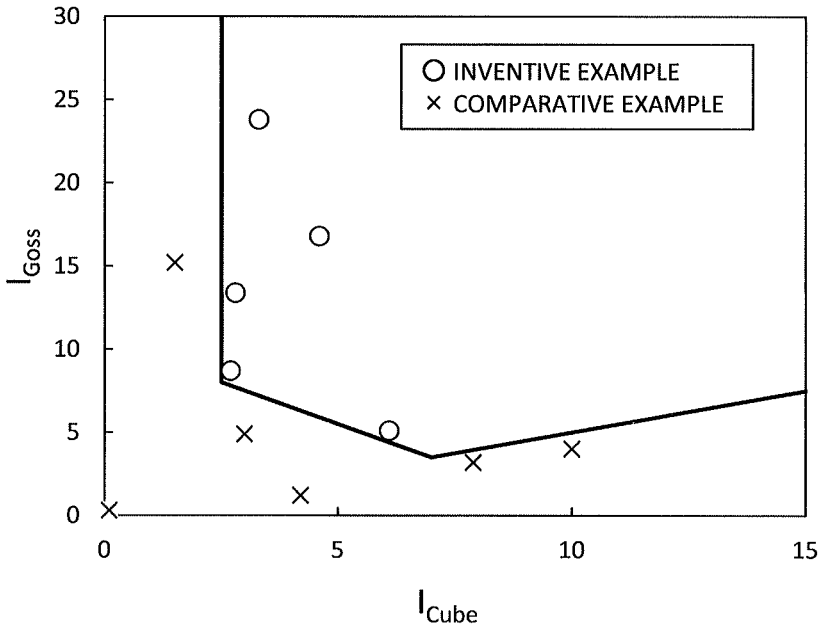
FIG. 3 is a view illustrating a distribution of the accumulation degree in the first test.

In FIG. 3, the accumulation degree $I_{Goss}$ and the accumulation degree $I_{Cube}$ of the above-described invention examples and comparative examples, and the relations of Expression 1, Expression 2, and Expression 3 are illustrated. As is clear from FIG. 1, FIG. 2, and FIG. 3, when all of Expression 1, Expression 2, and Expression 3 were satisfied, excellent magnetic properties in the L direction were able to be obtained under no stress and excellent magnetic properties in the C direction were able to be obtained under the compressive stress in the C direction.

Figure 4:
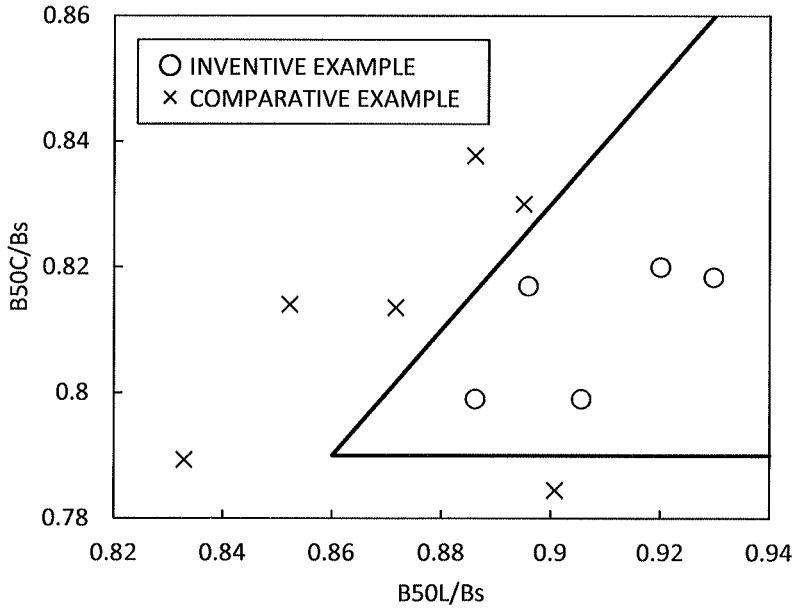
FIG. 4 is a view illustrating a distribution of a magnetic flux density in the first test.

FIG. 4 illustrates the relationship between the ratio of the magnetic flux density B50L to the saturation magnetic flux density Bs (B50L/Bs) and the ratio of the magnetic flux density B50C to the saturation magnetic flux density Bs (B50C/Bs). As illustrated in FIG. 4, the invention examples satisfy Expression 7 and Expression 8.

$$B50C/Bs\geq0.790 \quad \text{Expression 7}$$

$$(B50L-B50C)/Bs\geq0.070 \quad \text{Expression 8}$$

TABLE 1

| SAMPLE No. | $I_{Cube}$ | $I_{Goss}$ | $I_{Cube}+I_{Goss}$ | $I_{Goss}/I_{Cube}$ | AVERAGE CRYSTAL GRAIN DIAMETER (μm) | B50L | B50C | B50L/Bs | B50C/Bs | (B50L − B50C)/Bs | W15/400L | W15/400C | NOTE |
|---|---|---|---|---|---|---|---|---|---|---|---|---|---|
| 1 | 4.6 | 16.8 | 21.4 | 3.65 | 66 | 1.90 | 1.70 | 0.920 | 0.820 | 0.100 | 37.7 | 63.2 | INVENTION EXAMPLE |
| 2 | 2.7 | 8.7 | 11.4 | 3.22 | 69 | 1.83 | 1.65 | 0.886 | 0.799 | 0.087 | 39.9 | 64.1 | INVENTION EXAMPLE |
| 3 | 2.8 | 13.4 | 16.2 | 4.79 | 70 | 1.87 | 1.65 | 0.906 | 0.799 | 0.107 | 38.6 | 62.4 | INVENTION EXAMPLE |
| 4 | 3.3 | 23.8 | 27.1 | 7.21 | 71 | 1.92 | 1.69 | 0.930 | 0.818 | 0.111 | 36.2 | 61.4 | INVENTION EXAMPLE |
| 5 | 6.1 | 5.1 | 11.2 | 0.84 | 68 | 1.85 | 1.70 | 0.896 | 8.817 | 0.079 | 39.1 | 65.2 | INVENTION EXAMPLE |
| 6 | 7.9 | 3.2 | 11.1 | 0.41 | 67 | 1.86 | 1.74 | 0.895 | 0.830 | 0.065 | 39.6 | 71.6 | COMPARATIVE EXAMPLE |
| 7 | 1.5 | 15.2 | 16.7 | 10.13 | 72 | 1.86 | 1.62 | 0.901 | 0.784 | 0.116 | 38.9 | 68.4 | COMPARATIVE EXAMPLE |
| 8 | 3.0 | 4.9 | 7.9 | 1.63 | 70 | 1.80 | 1.68 | 0.872 | 0.814 | 0.058 | 41.2 | 62.8 | COMPARATIVE EXAMPLE |
| 9 | 4.2 | 1.2 | 5.4 | 0.29 | 68 | 1.76 | 1.68 | 0.852 | 0.814 | 0.038 | 42.6 | 71.9 | COMPARATIVE EXAMPLE |
| 10 | 10.0 | 4.0 | 14.0 | 0.40 | 71 | 1.83 | 1.73 | 0.886 | 0.838 | 0.048 | 39.6 | 70.5 | COMPARATIVE EXAMPLE |
| 11 | 0.1 | 0.3 | 0.4 | 3.00 | 69 | 1.72 | 1.63 | 0.833 | 0.789 | 0.044 | 42.2 | 69.2 | COMPARATIVE EXAMPLE |

(Second Test)

In the second test, the relationship of the condition of the intermediate annealing, the accumulation degree, and the magnetic properties was examined. First, a plurality of hot-rolled steel sheets each containing, in mass %, C: 0.002%, Si: 1.99%, Al: 0.0190%, Mn: 0.20%, S: 0.002%, N: 0.002%, and P: 0.012%, and balance being composed of Fe and impurities and having a sheet thickness of 2.5 mm were fabricated. Next, on the hot-rolled steel sheets, box hot-rolled sheet annealing for holding at a temperature of 800° C. for 10 hours was performed to obtain annealed steel sheets. The average crystal grain diameter of the annealed steel sheets was 70 μm. Thereafter, first cold rolling with a first cold rolling ratio of 60% was performed on the annealed steel sheets, to obtain intermediate cold-roiled steel sheets each having a sheet thickness of 1.0 mm. Subsequently, on the intermediate cold-rolled steel sheets, intermediate annealing was performed under the condition represented in Table 2 below, to obtain intermediate annealed steel sheets. As represented in Table 2, the average crystal grain diameter of the intermediate annealed steel sheets was 71 μm to 355 μm. Next, on the intermediate annealed steel sheets, second cold rolling was performed, to obtain cold-rolled steel sheets each having a sheet thickness of 0.30 mm. Thereafter, on the cold-rolled steel sheets, finish annealing for holding at 1000° C. for 15 seconds was performed, to obtain electrical steel sheets. As a result of a measurement by the above-described Schultz method, it was revealed that the accumulation degree $I_{Cube}$ was 2.3 to 4.1 and the accumulation degree $I_{Goss}$ was 6.5 to 24.5 as represented in Table 2 below. As a result of a measurement by the above-described method using a vertical section structure photograph, it was revealed that the average crystal grain diameter was 70 μm to 82 μm as represented in Table 2.

The magnetic flux density B501, and the magnetic flux density B50C were measured in the same manner as in the first test. Results thereof are represented in Table 2. In Table 2, each underline indicates that a corresponding numerical value is outside the present invention range or preferred range.

TABLE 2

| SAMPLE | INTERMEDIATE ANNEALING | | | AVERAGE CRYSTAL GRAIN DIAMETER OF INTERMEDIATE ANNEALED STEEL SHEET | | | | |
|---|---|---|---|---|---|---|---|---|
| No. | TYPE | TEMPERATURE | TIME | (μm) | $I_{Cube}$ | $I_{Goss}$ | $I_{Goss} + I_{Cube}$ | $I_{Goss}/I_{Cube}$ |
| 21 | BOX | 800° C. | 10 HOURS | 71 | 2.3 | 6.7 | 9.0 | 2.91 |
| 22 | BOX | 830° C. | 10 HOURS | 112 | 3.7 | 6.5 | 10.2 | 1.76 |
| 23 | BOX | 870° C. | 10 HOURS | 155 | 2.6 | 8.0 | 10.6 | 3.08 |
| 24 | BOX | 900° C. | 10 HOURS | 215 | 3.2 | 24.3 | 27.5 | 7.59 |
| 25 | BOX | 950° C. | 100 HOURS | 355 | 3.1 | 24.5 | 27.6 | 7.90 |
| 26 | CONTINUOUS | 1090° C. | 60 SECONDS | 161 | 3.3 | 9.9 | 13.2 | 3.00 |
| 27 | CONTINUOUS | 1120° C. | 30 SECONDS | 221 | 4.1 | 8.7 | 12.8 | 2.12 |

| SAMPLE No. | AVERAGE CRYSTAL GRAIN DIAMETER OF ELECTRICAL STEEL SHEET (μm) | B50L/Bs | B50C/Bs | (B50L − B50C)/Bs | NOTE |
|---|---|---|---|---|---|
| 21 | 78 | 0.865 | 0.819 | 0.046 | COMPARATIVE EXAMPLE |
| 22 | 82 | 0.882 | 0.818 | 0.064 | COMPARATIVE EXAMPLE |
| 23 | 81 | 0.893 | 0.820 | 0.073 | INVENTION EXAMPLE |
| 24 | 70 | 0.911 | 0.820 | 0.091 | INVENTION EXAMPLE |
| 25 | 76 | 0.922 | 0.799 | 0.123 | INVENTION EXAMPLE |
| 26 | 79 | 0.891 | 0.820 | 0.071 | INVENTION EXAMPLE |
| 27 | 80 | 0.901 | 0.814 | 0.087 | INVENTION EXAMPLE |

As represented in Table 2, in Samples No. 23 to No. 27, the intermediate annealing was performed under the preferred condition, and thereby a desired texture was able to be obtained and the magnetic properties satisfying Expression 7 and Expression 8 were able to be obtained. On the other hand, in Samples No. 21 and No. 22, the condition of the intermediate annealing was outside the preferred range, and therefore a desired texture was not able to be obtained and the magnetic properties did not satisfy Expression 8.

(Third Test)

In the third test, the relationship of the component, the accumulation degree, and the magnetic properties was examined. First, a plurality of hot-rolled steel sheets each containing the components represented in Table 3 and further containing Ti: 0.002%, V: 0.003%, and Nb: 0.002%, and balance being composed of Fe and impurities and having a sheet thickness of 2.0 mm were fabricated. Next, as hot-rolled sheet annealing, continuous annealing for holding at 1000° C. for 30 seconds was performed, to obtain annealed steel sheets. The average crystal grain diameter of the annealed steel sheets was 72 μm to 85 μm. Thereafter, first cold rolling with a first cold rolling ratio of 70% was performed on the annealed steel sheets, to obtain intermediate cold-rolled steel sheets each having a sheet thickness of 0.6 mm. Subsequently, on the intermediate cold-rolled steel sheets, box intermediate annealing for holding at 950° C. for 100 hours was performed, to obtain intermediate annealed steel sheets. The average crystal grain diameter of the intermediate annealed steel sheets was 280 μm to 343 μm. Next, on the intermediate annealed steel sheets, second cold rolling with a second cold rolling ratio of 58% was performed, to obtain cold-rolled steel sheets each having a sheet thickness of 0.25 mm. Thereafter, on the cold-rolled steel sheets, finish annealing for holding at a temperature of 1050° C. for 30 seconds was performed, to obtain electrical steel sheets. As a result of a measurement by the above-described Schultz method, it was revealed that the accumulation degree $I_{Cube}$ was 1.9 to 3.9 and the accumulation degree $I_{Goss}$ was 8.0 to 21.3 as represented in Table 4 below. As a result of a measurement by the above-described method using a vertical section structure photograph, it was revealed that the average crystal grain diameter is 112 μm to 123 μm as represented in Table 4.

Then, the magnetic flux density B50L and the magnetic flux density B50C were measured in the same manner as in the first test. Results thereof are represented in Table 4. In Table 3 or Table 4, each underline indicates that a corresponding numerical value is outside the present invention range or preferred range.

TABLE 3

| SAMPLE | CHEMICAL COMPOSITION (MASS %) | | | | | | | | | | | |
|---|---|---|---|---|---|---|---|---|---|---|---|---|
| No. | Si | Mn | Al | C | S | N | P | Sn | Sb | Cr | Cu | Ni |
| 31 | 1.99 | 0.20 | 0.0003 | 0.002 | 0.001 | 0.002 | 0.012 | 0.003 | 0.001 | 0.02 | 0.03 | 0.01 |
| 32 | 2.00 | 0.19 | 0.1100 | 0.003 | 0.003 | 0.002 | 0.011 | 0.003 | 0.001 | 0.01 | 0.02 | 0.02 |
| 33 | 2.10 | 0.20 | 0.0030 | 0.004 | 0.002 | 0.003 | 0.015 | 0.020 | 0.002 | 0.20 | 0.10 | 0.20 |
| 34 | 2.54 | 1.00 | 0.0004 | 0.002 | 0.002 | 0.003 | 0.015 | 0.001 | 0.002 | 0.02 | 0.02 | 0.03 |
| 35 | 2.60 | 0.32 | 0.3000 | 0.001 | 0.003 | 0.002 | 0.082 | 0.003 | 0.007 | 0.02 | 0.02 | 0.02 |
| 36 | 3.01 | 0.18 | 0.0003 | 0.004 | 0.002 | 0.001 | 0.014 | 0.002 | 0.001 | 0.02 | 0.03 | 0.03 |
| 37 | 2.50 | 0.20 | 0.7000 | 0.002 | 0.003 | 0.002 | 0.013 | 0.002 | 0.001 | 0.03 | 0.02 | 0.01 |
| 38 | 2.50 | 0.20 | 1.2000 | 0.002 | 0.003 | 0.002 | 0.013 | 0.002 | 0.001 | 0.03 | 0.02 | 0.01 |
| 39 | 2.50 | 0.20 | 1.7000 | 0.002 | 0.003 | 0.002 | 0.013 | 0.002 | 0.001 | 0.03 | 0.02 | 0.01 |
| 40 | 3.05 | 0.25 | 2.1000 | 0.002 | 0.003 | 0.002 | 0.008 | 0.003 | 0.004 | 0.01 | 0.02 | 0.02 |
| 41 | 3.58 | 0.19 | 0.0120 | 0.002 | 0.003 | 0.002 | 0.013 | 0.002 | 0.001 | 0.03 | 0.02 | 0.01 |

TABLE 4

| SAMPLE No. | $I_{Cube}$ | $I_{Goss}$ | $I_{Goss} + I_{Cube}$ | $I_{Goss}/I_{Cube}$ | AVERAGE CRYSTAL GRAIN DIAMETER (μm) | B50L/Bs | B50C/Bs | (B50L − B50C)/Bs | NOTE |
|---|---|---|---|---|---|---|---|---|---|
| 31 | 3.8 | 21.3 | 25.1 | 5.6 | 123 | 0.918 | 0.816 | 0.102 | INVENTION EXAMPLE |
| 32 | 3.9 | 18.7 | 22.6 | 4.8 | 118 | 0.914 | 0.817 | 0.097 | INVENTION EXAMPLE |
| 33 | 3.6 | 18.9 | 22.5 | 5.3 | 112 | 0.914 | 0.818 | 0.096 | INVENTION EXAMPLE |
| 34 | 3.3 | 16.5 | 19.8 | 5.0 | 115 | 0.911 | 0.812 | 0.099 | INVENTION EXAMPLE |
| 35 | 3.1 | 14.2 | 17.3 | 4.6 | 116 | 0.905 | 0.813 | 0.092 | INVENTION EXAMPLE |
| 36 | 3.0 | 10.7 | 13.7 | 3.6 | 121 | 0.910 | 0.819 | 0.091 | INVENTION EXAMPLE |
| 37 | 3.1 | 10.6 | 13.7 | 3.4 | 113 | 0.895 | 0.805 | 0.090 | INVENTION EXAMPLE |
| 38 | 2.6 | 8.0 | 10.6 | 3.1 | 119 | 0.877 | 0.806 | 0.071 | INVENTION EXAMPLE |
| 39 | 2.1 | 8.2 | 10.3 | 3.9 | 116 | 0.869 | 0.811 | 0.058 | COMPARATIVE EXAMPLE |
| 40 | 1.9 | 9.1 | 11.0 | 4.8 | 120 | 0.873 | 0.809 | 0.064 | COMPARATIVE EXAMPLE |
| 41 | 2.3 | 8.7 | 11.0 | 3.8 | 117 | 0.871 | 0.805 | 0.066 | COMPARATIVE EXAMPLE |

In Samples No. 31 to No. 38, the components were within the present invention range, and therefore a desired texture was able to be obtained and the magnetic properties satisfying Expression 7 and Expression 8 were able to be obtained. On the other hand, in Samples No. 39 to No. 41, the content of Al or the content of Si was outside the present invention range, and therefore a desired texture was not able to be obtained and the magnetic properties did not satisfy Expression 8.

(Fourth Test)

In the fourth test, the relationship between the conditions of the hot-rolled sheet annealing, the first cold rolling, and the second cold rolling and the magnetic properties was examined. First, hot-rolled steel sheets each containing, in mass %, C: 0.002%, Si: 2.15%, Al: 0.0050%, Mn: 0.20%, S: 0.003%, N: 0.001%, P: 0.016%, Sn: 0.003%, Sb: 0.002%, Cr: 0.02%, Cu: 0.01%, Ni: 0.01%, Ti: 0.003%, V: 0.001%, and Nb: 0.002%, and balance being composed of Fe and impurities and having a sheet thickness of 1.6 mm to 2.5 mm were fabricated. Next, on the hot-rolled steel sheets, hot-rolled sheet annealing was performed under the condition represented in Table 5 below, to obtain annealed steel sheets. As represented in Table 5, the average crystal grain diameter of the annealed steel sheets was 24 μm to 135 μm. Thereafter, first cold rolling with a first cold rolling ratio of 35% to 75% was performed on the annealed steel sheets, to obtain intermediate cold-rolled steel sheets each having a sheet thickness of 0.5 mm to 1.3 mm. Subsequently, on the intermediate cold-rolled steel sheets, box intermediate annealing for holding at 950° C. for 10 hours was performed, to obtain intermediate annealed steel sheets. The average crystal grain diameter of the intermediate annealed steel sheets was 295 μm to 314 μm. Next, on the intermediate annealed steel sheets, second cold rolling with a second cold rolling ratio of 30% to 86% was performed, to obtain cold-rolled steel sheets each having a sheet thickness of 0.15 mm to 0.35 mm. Thereafter, on the cold-rolled steel sheets, finish annealing for holding at a temperature of 800° C. to 1120° C. for a time period of 15 seconds to 60 seconds was performed, to obtain electrical steel sheets. As a result of a measurement by the above-described Schultz method, it was revealed that the accumulation degree $I_{Cube}$ was 1.5 to 3.7 and the accumulation degree $I_{Goss}$ was 5.5 to 16.4 as represented in Table 6 below. As a result of a measurement by the above-described method using a vertical section structure photograph, it was revealed that the average crystal grain diameter is 32 μm to 192 μm as represented in Table 6.

The magnetic flux density B50L and the magnetic flux density B50C were measured in the same manner as in the first test. Results thereof are represented in Table 6. In Table 5 or Table 6, each underline indicates that a corresponding numerical value is outside the present invention range or preferred range.

(Fifth Test)

In the fifth test, 4-pole 6-slot interior permanent magnet (IPM) divided iron core motors were fabricated using the electrical steel sheets of Sample No. 3, Sample No. 7, and Sample No. 8 as an iron core material, of which torque constants under the condition of a load torque being 1 Nm, 2 Nm, and 3 Nm were measured. The IMP divided iron core motor was set so as to make the L direction of the electrical steel sheet parallel to a teeth part of a motor iron core and make the C direction thereof parallel to a back yoke part thereof. The torque constant is a value obtained by normalizing an appropriate torque by a current value necessary for outputting the torque. In other words, the torque constant corresponds to a torque per 1 A of current, and the higher the torque constant is, the more preferable it is. Results thereof are represented in Table 7. In Table 7, each underline indicates that a corresponding numerical value is outside the present invention range.

TABLE 5

| SAMPLE No. | THICKNESS OF HOT-ROLLED STEEL SHEET (mm) | HOT-ROLLED SHEET ANNEALING TYPE | TEMPERATURE | TIME | AVERAGE CRYSTAL GRAIN DIAMETER OF ANNEALED STEEL SHEET (μm) | FIRST COLD ROLLING RATIO (%) |
|---|---|---|---|---|---|---|
| 51 | 1.6 | BOX | 800° C. | 10 HOURS | 94 | 69 |
| 52 | 2.0 | CONTINUOUS | 830° C. | 60 SECONDS | 52 | 75 |
| 53 | 2.5 | BOX | 850° C. | 20 HOURS | 135 | 52 |
| 54 | 1.6 | BOX | 680° C. | 5 HOURS | 24 | 69 |
| 55 | 2.0 | CONTINUOUS | 830° C. | 60 SECONDS | 52 | 75 |
| 56 | 2.0 | CONTINUOUS | 830° C. | 60 SECONDS | 52 | 35 |
| 57 | 2.5 | BOX | 850° C. | 20 HOURS | 135 | 56 |

| SAMPLE No. | THICKNESS OF INTERMEDIATE COLD-ROLLED STEEL SHEET (mm) | SECOND COLD ROLLING RATIO (%) | THICKNESS OF COLD-ROLLED STEEL SHEET (mm) | FINISH ANNEALING TEMPERATURE | TIME |
|---|---|---|---|---|---|
| 51 | 0.5 | 50 | 0.25 | 800° C. | 30 SECONDS |
| 52 | 0.5 | 70 | 0.15 | 900° C. | 60 SECONDS |
| 53 | 1.2 | 75 | 0.30 | 1120° C. | 30 SECONDS |
| 54 | 0.5 | 50 | 0.25 | 800° C. | 30 SECONDS |
| 55 | 0.5 | 30 | 0.35 | 900° C. | 60 SECONDS |
| 56 | 1.3 | 73 | 0.35 | 900° C. | 60 SECONDS |
| 57 | 1.1 | 86 | 0.15 | 1050° C. | 15 SECONDS |

TABLE 6

| SAMPLE No. | $I_{Cube}$ | $I_{Goss}$ | $I_{Goss}+I_{Cube}$ | $I_{Goss}/I_{Cube}$ | AVERAGE CRYSTAL GRAIN DIAMETER (μm) | B50L/Bs | B50C/Bs | (B50L − B50C)/Bs | NOTE |
|---|---|---|---|---|---|---|---|---|---|
| 51 | 3.2 | 12.5 | 15.7 | 3.9 | 35 | 0.911 | 0.814 | 0.097 | INVENTION EXAMPLE |
| 52 | 3.4 | 15.4 | 18.8 | 4.5 | 67 | 0.915 | 0.813 | 0.102 | INVENTION EXAMPLE |
| 53 | 3.4 | 16.4 | 19.8 | 4.8 | 192 | 0.913 | 0.811 | 0.102 | INVENTION EXAMPLE |
| 54 | 3.1 | 6.9 | 10.0 | 2.2 | 32 | 0.885 | 0.820 | 0.065 | COMPARATIVE EXAMPLE |
| 55 | 3.7 | 5.5 | 9.2 | 1.5 | 71 | 0.878 | 0.824 | 0.054 | COMPARATIVE EXAMPLE |
| 56 | 2.4 | 7.2 | 9.6 | 3.0 | 66 | 0.879 | 0.813 | 0.066 | COMPARATIVE EXAMPLE |
| 57 | 1.5 | 6.5 | 8.0 | 4.3 | 106 | 0.864 | 0.788 | 0.076 | COMPARATIVE EXAMPLE |

In Samples No. 51 to No. 53, the hot-rolled sheet annealing, the first cold rolling, and the second cold rolling were performed under the preferred conditions, and therefore a desired texture was able to be obtained and the magnetic properties satisfying Expression 7 and Expression 8 were able to be obtained. On the other hand, in Samples No. 54 to No. 57, the condition of the hot-rolled sheet annealing, the first cold rolling, or the second cold rolling was outside the preferred range, and therefore a desired texture was not able to be obtained and the magnetic properties did not satisfy Expression 7 or Expression 8.

TABLE 7

| SAMPLE | TEXTURE | | | | TORQUE CONSTANT (Nm/A) | | | | |
|---|---|---|---|---|---|---|---|---|---|
| No. | $I_{cube}$ | $I_{Goss}$ | $I_{Goss}+I_{Cube}$ | $I_{Goss}/I_{Cube}$ | 1 Nm | 2 Nm | 3 Nm | AVERAGE | NOTE |
| 3 | 2.8 | 13.4 | 16.2 | 4.8 | 0.519 | 0.557 | 0.564 | 0.547 | INVENTION EXAMPLE |
| 7 | 1.5 | 15.2 | 16.7 | 10.1 | 0.512 | 0.552 | 0.563 | 0.542 | COMPARATIVE EXAMPLE |
| 8 | 3.0 | 4.9 | 7.9 | 1.6 | 0.518 | 0.552 | 0.548 | 0.539 | COMPARATIVE EXAMPLE |

As represented in Table 7, the torque constant of the divided iron core motor using Sample No. 3 as an iron core material was more excellent than the torque constants of the divided iron core motors using Sample No. 7 and Sample No. 8 as an iron core material under all the load torques. On the other hand, the torque constant of the divided iron core motor using Sample No. 7 or Sample No. 8 as an iron core material was low under the condition of particularly the load torque being low.

INDUSTRIAL APPLICABILITY

The present invention may be used for, for example, industries of manufacturing an electrical steel sheet and industries of using the electrical steel sheet such as motors.

The invention claimed is:

1. An electrical steel sheet, comprising:

a chemical composition represented by, in mass %:

C: 0.010% or less;

Si; 1.30% to 3.50%;

Al: 0.0000% to 1.6000%;

Mn: 0.01% to 3.00%;

S: 0.0100% or less;

N: 0.010% or less;

P: 0.000% to 0.150%;

Sn: 0.000% to 0.150%;

Sb: 0.000% to 0.150%;

Cr: 0.000% to 1.000%;

Cu: 0.000% to 1.000%;

Ni: 0.000% to 1.000%;

Ti: 0.010% or less;

V: 0.010% or less;

Nb: 0.010% or less; and balance comprising Fe and impurities;

a crystal grain diameter of 20 μm to 300 μM; and a texture satisfying Expression 1, Expression 2, and Expression 3 when the accumulation degree of the (001)[100] orientation is represented as $I_{Cube}$ and the accumulation degree of the (011)[100] orientation is represented as $I_{Goss}$, $$I_{Goss}+I_{Cube}\geq 10.5 \quad \text{Expression 1}$$

$$I_{Goss}/I_{Cube}\geq 0.50 \quad \text{Expression 2}$$

$$I_{Cube}\geq 2.5 \quad \text{Expression 3.}$$

2. The electrical steel sheet according to claim 1, wherein the texture satisfies Expression 4, Expression 5, and Expression 6, $$I_{Goss}+I_{Cube}\geq 10.7 \quad \text{Expression 4}$$

$$I_{Goss}/I_{Cube}\geq 0.52 \quad \text{Expression 5}$$

$$I_{Cube}\geq 2.7 \quad \text{Expression 6.}$$

3. The electrical steel sheet according to claim 2, further comprising:

a magnetic property satisfying Expression 7 and Expression 8 when a saturation magnetic flux density is represented as Bs, a magnetic flux density in a rolling direction at being magnetized by a magnetizing force of 5000 A/m is represented as B50L, and a magnetic flux density in a direction perpendicular to the rolling direction and a sheet thickness direction at being magnetized by a magnetizing force of 5000 A/m is represented as B50C, $$B50C/Bs\geq 0.790 \quad \text{Expression 7}$$

$$(B50L-B50C)/Bs\geq 0.070 \quad \text{Expression 8.}$$

4. The electrical steel sheet according to claim 3, wherein the magnetic property satisfies Expression 9, $$(B50L-B50C)/Bs\geq 0.075 \quad \text{Expression 9.}$$

5. The electrical steel sheet according to claim 4, wherein the magnetic property satisfies Expression 10, $$B50C/Bs\leq 0.825 \quad \text{Expression 10.}$$

6. The electrical steel sheet according to claim 1, wherein in the chemical composition, P: 0.001% to 0.150%, Sn: 0.001% to 0.150%, or Sb: 0.001% to 0.150%, or any combination thereof is satisfied.

7. The electrical steel sheet according to claim 6, wherein in the chemical composition, Cr: 0.005% to 1.000%, Cu: 0.005% to 1.000%, or Ni: 0.005% to 1.000%, or any combination thereof is satisfied.

8. The electrical steel sheet according to claim 1, wherein a thickness thereof is 0.10 mm to 0.50 mm.

* * * * *